US010961869B2

(12) United States Patent
Von Berg

(10) Patent No.: US 10,961,869 B2
(45) Date of Patent: Mar. 30, 2021

(54) CONCENTRIC JACK SCREW HOLES

(71) Applicant: United Technologies Corporation, Farmington, CT (US)

(72) Inventor: Kaleb Von Berg, Middletown, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 112 days.

(21) Appl. No.: 16/357,439

(22) Filed: Mar. 19, 2019

(65) Prior Publication Data

US 2020/0300167 A1 Sep. 24, 2020

(51) Int. Cl.
*F01D 25/24* (2006.01)
*F04D 29/60* (2006.01)

(52) U.S. Cl.
CPC ..... *F01D 25/243* (2013.01); *F04D 29/60* (2013.01)

(58) Field of Classification Search
CPC ..... F01D 25/243; F04D 29/60
See application file for complete search history.

(56) References Cited

U.S. PATENT DOCUMENTS

| | | | | |
|---|---|---|---|---|
| RE33,490 | E | 12/1990 | Steinbock | |
| 5,083,889 | A | 1/1992 | Steinbock | |
| 8,393,598 | B2 | 3/2013 | Sievers et al. | |
| 9,879,565 | B2 * | 1/2018 | Rogers | F01D 25/243 |
| 2005/0044685 | A1 * | 3/2005 | Brooks | F01D 25/243 29/426.5 |
| 2019/0390571 | A1 | 12/2019 | Canelle et al. | |

FOREIGN PATENT DOCUMENTS

| | | |
|---|---|---|
| EP | 1510296 A1 | 3/2005 |
| EP | 2905431 A1 | 8/2015 |
| EP | 3048270 A1 | 7/2016 |

OTHER PUBLICATIONS

European Search Report for EP Application No. 20163747.7 dated Jun. 15, 2020.

* cited by examiner

*Primary Examiner* — Richard A Edgar
(74) *Attorney, Agent, or Firm* — Carlson, Gaskey & Olds, P.C.

(57) ABSTRACT

A gas turbine engine component includes a first flange with a plurality of first jack screw holes and a second flange attached to the first flange. The second flange includes a plurality of second jack screw holes that are concentric with the plurality of first jack screw holes.

20 Claims, 4 Drawing Sheets

CONCENTRIC JACK SCREW HOLES

BACKGROUND

This application relates to a method and apparatus that includes disassembly features for separating axially adjacent flanges that provide for a more compact and efficient configuration over prior configurations. Specifically, concentric jack screw holes are provided in the flanges to allow for separation of the flanges from each other in an efficient manner.

Gas turbine engines are known and typically include a fan delivering air into a bypass duct as bypass air and into a compressor as core air. The air is compressed and delivered into a combustor section where it is mixed with fuel and ignited. Products of the combustion pass downstream over turbine rotors, driving them to rotate. The gas turbine engines include multiple bearing compartments to house bearings that support rotating engine components. Additionally, the gas turbine engine includes a plurality of case portions that enclose the compressor, turbine, and combustor sections of the engine.

The bearing compartments and case portions typically include a plurality of axially aligned flanges that are fastened together. In one known configuration, a seal housing support flange and a carbon seal housing flange are bolted to a mid-turbine frame flange and bearing support housing. The seal housing support flange, the carbon seal housing flange, and mid-turbine frame flange have to be able to be disassembled from the bearing support housing. A first set of holes are formed in the seal housing support flange to receive jack screws that can separate the seal housing support flange from the carbon seal housing flange. A second set of holes are formed in the mid-turbine frame flange to receive jack screws that can separate the carbon seal housing flange and mid-turbine frame flange from the bearing support housing. The first and second sets of holes are circumferentially offset from each other. The first and second sets of holes are also circumferentially offset from alignment holes, clearance cut-outs for other components, and fastener holes that receive the fasteners to attach the flanges to each other.

All of these different holes and cut-outs that are formed on the flanges take up a significant amount of the flange face area, leaving limited radial and circumferential space to accommodate the disassembly features, e.g. jack screw holes. As engine sizes become more compact, real estate for packaging all of the critical design features becomes even more limited. Thus, it is challenging to provide disassembly solutions in the limited available space.

SUMMARY

In a featured embodiment, gas turbine engine component includes a first flange with a plurality of first jack screw holes and a second flange attached to the first flange. The second flange includes a plurality of second jack screw holes that are concentric with the plurality of first jack screw holes.

In another embodiment according to the previous embodiment, each first jack screw hole has a first diameter and each second jack screw hole has a second diameter that is different than the first diameter.

In another embodiment according to any of the previous embodiments, a first jack screw is configured to engage one first jack screw hole and pass through a respective second jack screw hole that is concentric with the one first jack screw hole to remove the first flange from the second flange.

In another embodiment according to any of the previous embodiments, a second jack screw is configured to engage one second jack screw hole to remove the second flange from a third flange.

In another embodiment according to any of the previous embodiments, the second diameter is greater than the first diameter, and wherein the second jack screw has a larger diameter than the first jack screw.

In another embodiment according to any of the previous embodiments, the first flange includes a plurality of first fastener holes and the second flange includes a plurality of second fastener holes that are concentric with the plurality of first fastener holes, and including a plurality of fasteners that are received within the first and second fastener holes to attach the first and second flanges to a third flange.

In another embodiment according to any of the previous embodiments, the first and second jack screw holes are circumferentially offset from the first and second fastener holes.

In another embodiment according to any of the previous embodiments, the first flange includes at least one cut-out along an outer peripheral edge of the first flange such that at least one fastener of the plurality of fasteners does not pass through the first flange and is only used to connect the second flange to the third flange.

In another embodiment according to any of the previous embodiments, the first and second flanges extend around an engine center axis, and wherein the first and second flanges are directly axially adjacent to each other in a direction along the engine center axis.

In another embodiment according to any of the previous embodiments, the first jack screw holes are circumferentially spaced apart from each other about the engine center axis and wherein each first jack screw hole has a first center axis, and wherein the second jack screw holes are circumferentially spaced apart from each other about the engine center axis and wherein each second jack screw hole has a second center axis, and wherein each first jack screw hole is axially aligned with one second jack screw hole such that the first and second center axes are concentric.

In another embodiment according to any of the previous embodiments, the first flange comprises an intershaft seal support flange and the second flange comprises a centering spring flange, and wherein the intershaft seal support flange and the centering spring flange are attached to a bearing support flange with a plurality of fasteners.

In another featured embodiment, a gas turbine engine includes a compressor section, a combustor section downstream of the compressor section, and a turbine section downstream of the combustor section. The compressor and turbine sections include components that rotate about an engine center axis. At least one of the compressor, combustor, and turbine sections include a first flange with a plurality of first jack screw holes, a second flange attached to the first flange with a plurality of fasteners. The second flange includes a plurality of second jack screw holes that are concentric with the plurality of first jack screw holes. A third flange is attached to the first and second flanges with the plurality of fasteners.

In another embodiment according to any of the previous embodiments, each first jack screw hole has a first diameter and each second jack screw hole has a second diameter that is greater than the first diameter, and including a first jack screw configured to engage one first jack screw hole and pass through a respective second jack screw hole that is concentric with the one first jack screw hole to remove the first flange from the second flange subsequent to the plurality of fasteners being removed, and including a second jack screw configured to engage one second jack screw hole to remove the second flange from the third flange.

In another embodiment according to any of the previous embodiments, the first and second jack screw holes are threaded, and wherein the second jack screw has a larger diameter than the first jack screw.

In another embodiment according to any of the previous embodiments, the first jack screw holes are circumferentially spaced apart from each other about the engine center axis and wherein each first jack screw hole has a first center axis, and wherein the second jack screw holes are circumferentially spaced apart from each other about the engine center axis and wherein each second jack screw hole has a second center axis, and wherein each first jack screw hole is axially aligned with one second jack screw hole such that the first and second center axes are concentric.

In another featured embodiment, a method includes providing at least a first flange, a second flange, and a third flange that are assembled together with a plurality of fasteners; providing the first flange with a plurality of first jack screw holes and the second flange with a plurality of second jack screw holes that are concentric with the plurality of first jack screw holes; inserting a first jack screw into the first jack screw hole to remove the first flange from the second and third flanges subsequent to removing the plurality of fasteners; and inserting a second jack screw into the second jack screw hole to remove the second flange from the third flange subsequent to removing the first flange.

In another embodiment according to any of the previous embodiments, each first jack screw hole has a first diameter and each second jack screw hole has a second diameter that is greater than the first diameter such that as the first jack screw is threaded into the first jack screw hole, a distal end of the first jack screw passes through the second jack screw hole to react against the third flange to remove the first flange from the second flange.

In another embodiment according to any of the previous embodiments, the first jack screw has a first screw diameter and the second jack screw has a second screw diameter that is greater than the first screw diameter such that as the second jack screw is threaded into the second jack screw hole, a distal end of the second jack screw reacts against the third flange to remove the second flange from the third flange.

In another embodiment according to any of the previous embodiments, the first and second jack screw holes are circumferentially offset from fastener holes that receive the plurality of fasteners, and the method includes forming at least one cut-out along an outer peripheral edge of the first flange such that at least one fastener of the plurality of fasteners does not pass through the first flange and is only used to connect the second flange to the third flange, removing all fasteners from the plurality of fasteners except for the at least one fastener that connects the second flange to the first flange, and subsequently inserting the first jack screw into the first jack screw hole to remove the first flange from the second flange while the at least one fastener fixes the second flange to the third flange.

In another embodiment according to any of the previous embodiments, the method includes, subsequent to removing the first flange from the second flange, removing the at least one fastener from the second and third flanges, and inserting the second jack screw into the second jack screw hole to remove the second flange from the third flange.

These and other features may be best understood from the following drawings and specification.

DETAILED DESCRIPTION

Figure 1:
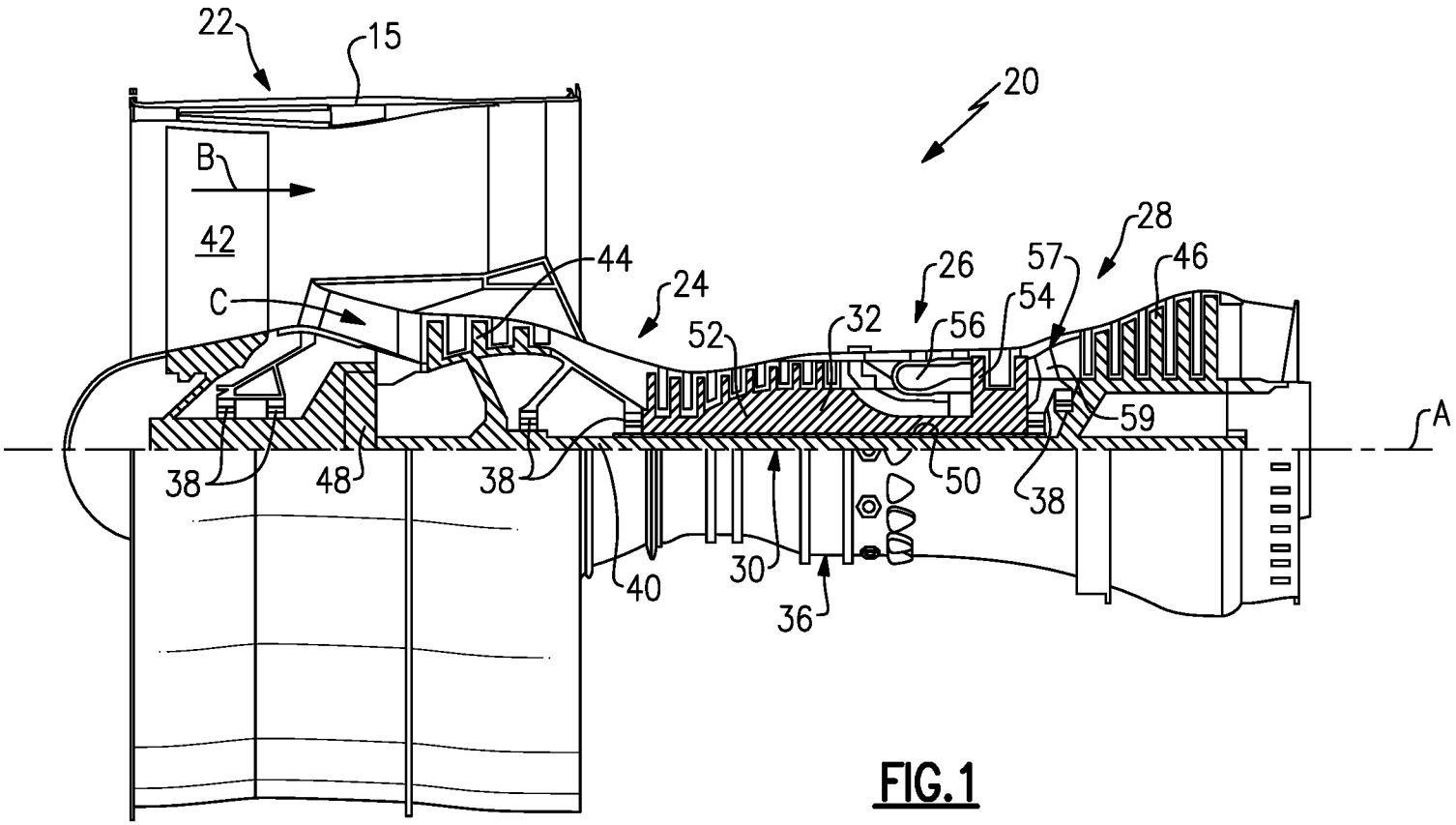
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a first (or low) pressure compressor 44 and a first (or low) pressure turbine 46. The inner shaft 40 is connected to a fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Optionally, the engine could comprise a turbine engine that does not include a bypass. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
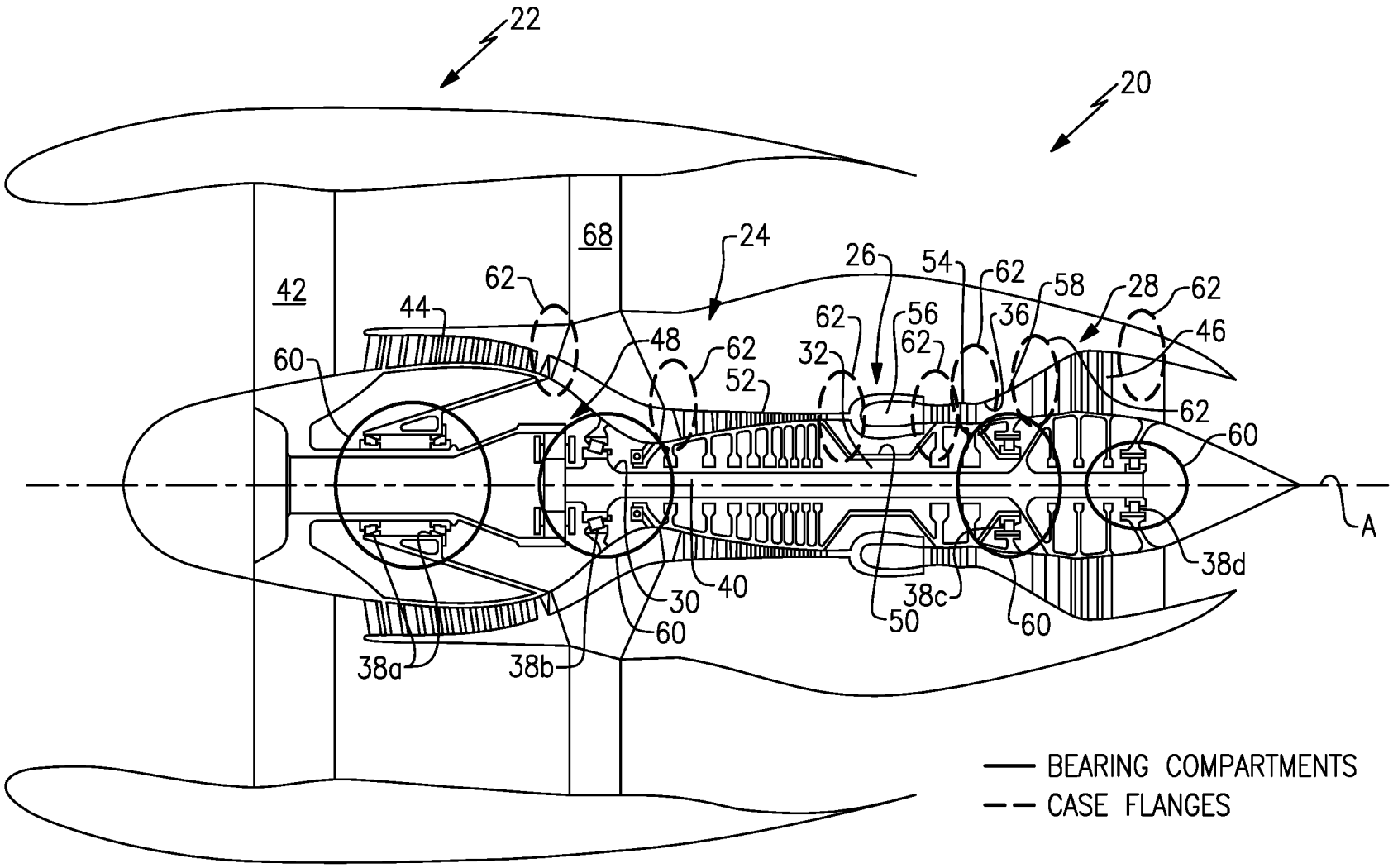
FIG. 2 shows a schematic illustration of examples of bearing compartment and case flange locations of the gas turbine engine of FIG. 1 that can utilize the subject invention.

The subject invention provides a simple and effective method of flange disassembly at various locations within the engine 20. FIG. 2 shows flange assemblies 60 for a plurality of bearing compartments 38*a*, 38*b*, 38*c*, 38*d* that are located at various positions within the engine 20. The case structure also include a plurality of flange assemblies 62 along the length of the engine 20. Each of these flange assemblies 60, 62 require disassembly features that allow the flanges to be easily separated from each other for maintenance and/or repair purposes. The subject invention provides a method and apparatus with disassembly features that provide for an inexpensive and simple disassembly process.

Figure 3:
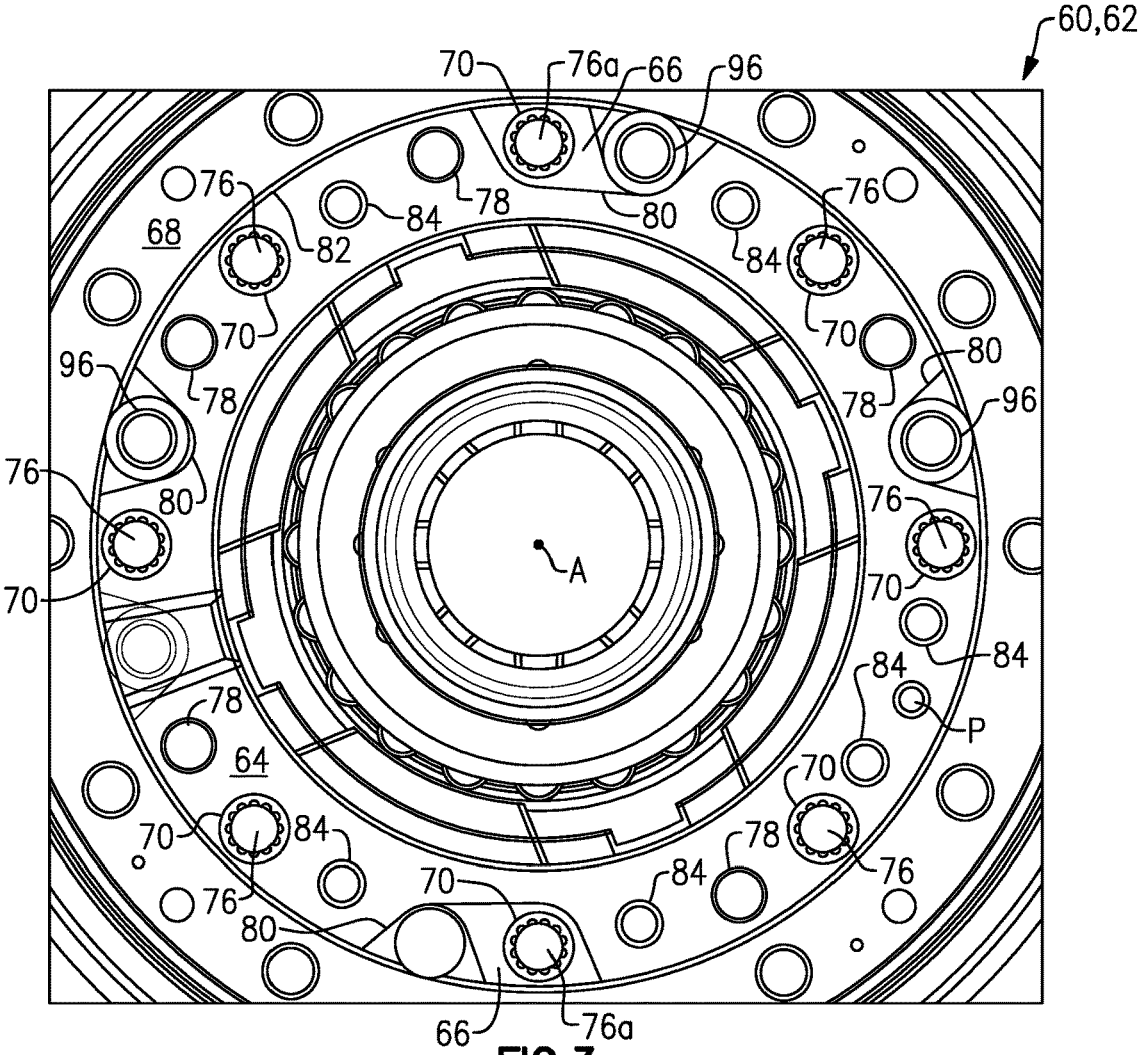
FIG. 3 is an end view of a plurality of flanges bolted together and which include the disassembly features of the subject invention.
Figure 4:
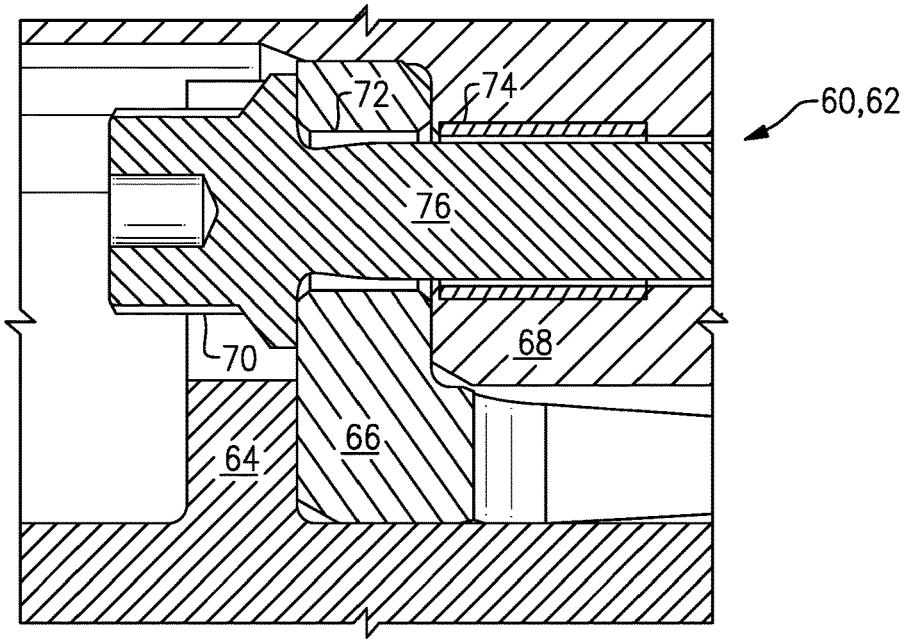
FIG. 4 is a section view of one bolt extending through the flanges of FIG. 3.

FIG. 3 shows one example where a first flange 64 is fixed to a second flange 66. The first 64 and second 66 flanges are attached to a third flange 68. The first 64, second 66, and third 68 flanges extend around the engine center axis A, and the first 64, second 66, and third 68 flanges are directly axially adjacent to each other in a direction along the engine center axis A. A plurality of first fastener holes 70 are formed in the first flange 64, a plurality of second fastener holes 72 (FIG. 4) are formed in the second flange 66, and a plurality of third fastener holes 74 are formed in the third flange 68. The first 70, second 72, and third 74 holes are concentric and axially aligned with each other such that fasteners 76 can be inserted through the aligned holes 70, 72, 74 to connect the first 64, second 66, and third 68 flanges together as shown in FIG. 4.

FIG. 3 also shows that the first flange 64 includes a plurality of by-pass holes 78, at least one locating pin P, and a plurality of clearance cut-outs 80 that are formed along an outer peripheral edge 82 of the first flange 64. The by-pass holes 78 can be used as flow passages or as passages through which other components can be inserted. The clearance cut-outs 80 can be used for jumper tubes 96 or other components as known. The cut-outs 80 also provide for one or more locations for fasteners 76*a* that do not pass through the first flange 64. Instead, these cut-outs 80 expose a portion of the second flange 66 such that the fasteners 76*a* only pass through the second 72 and third 74 fastener holes. Thus, the fasteners 76*a* do not pass through the first flange 64 and are only used to connect the second flange 66 to the third 68 flange.

The first fastener holes 70, by-pass holes 78, locating pin P, and cut-outs 80 are all circumferentially spaced apart from each other about the engine center axis A. As can be seen from FIG. 3, there is very little circumferential and radial space to include disassembly features that can be used to disassemble the first 64 and second 66 flanges from the third flange 68. The subject invention provides a disassembly feature that is efficiently packaged within the limited remaining circumferential and radial space. In the example shown, the first flange 64 comprises an intershaft seal support flange, the second flange 66 comprises a centering spring flange, and the third flange 68 comprises a bearing support flange; however, it should be understood that this is merely one example configuration and that other flange assemblies including more or less flanges could also utilize the subject invention.

Figure 6:
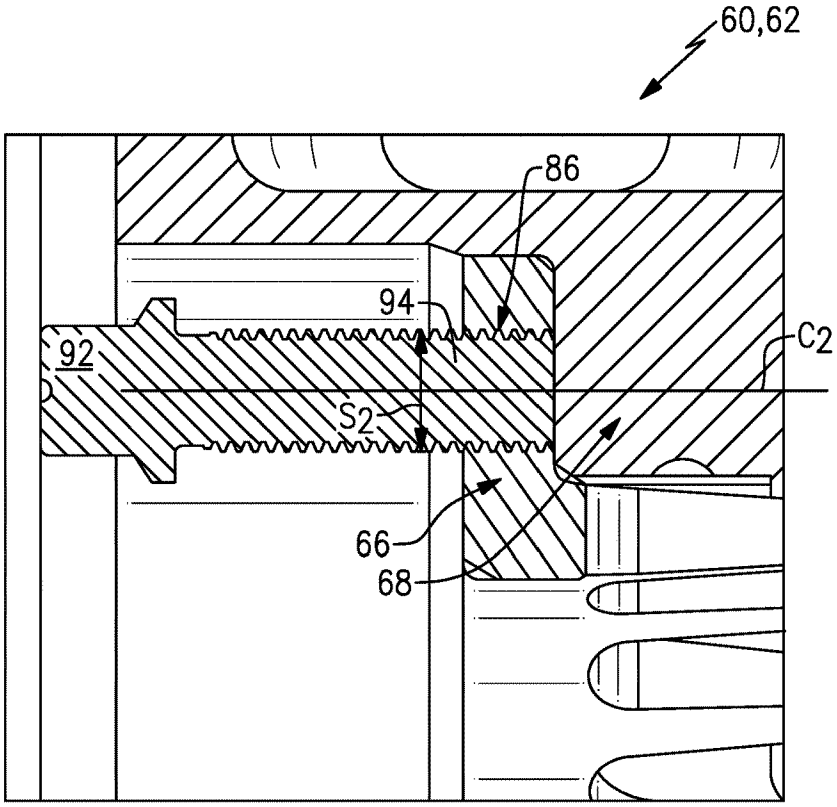
FIG. 6 is a section view through the flanges of FIG. 3 using a second jack screw to disassemble a second flange from the plurality of flanges.
Figure 5:
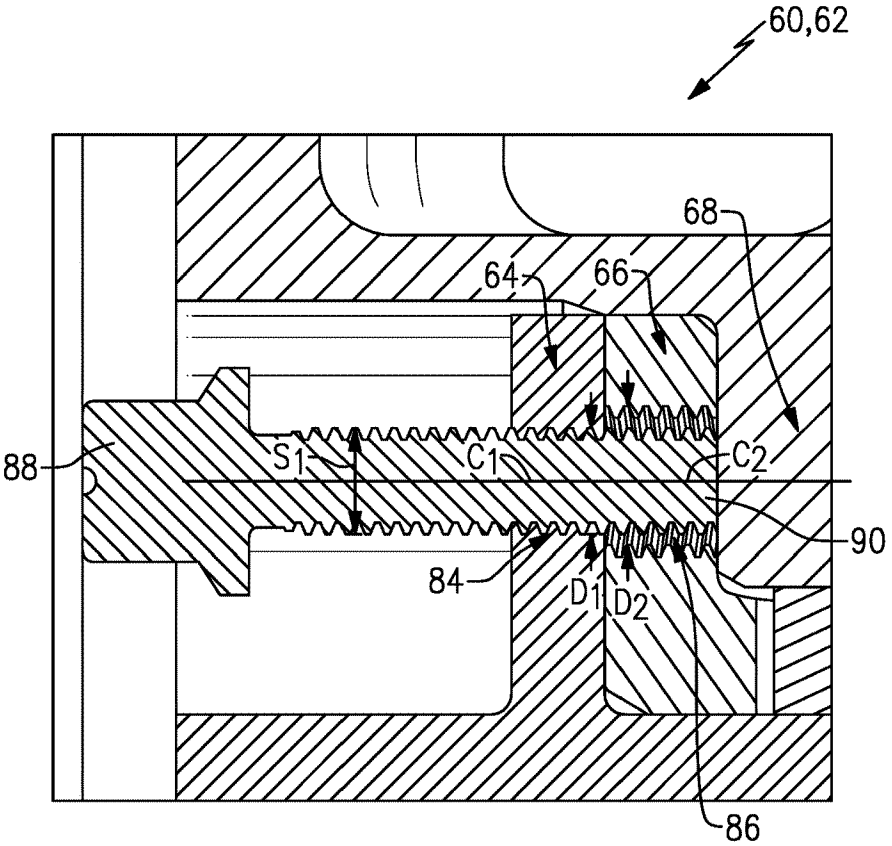
FIG. 5 is a section view through the flanges of FIG. 3 using a first jack screw to disassemble a first flange from the plurality of flanges.

In the example shown in FIGS. 3-6, the first flange 64 includes a plurality of first jack screw holes 84 (FIGS. 3 and 5) and the second flange 66 includes a plurality of second jack screw holes 86 (FIG. 6) that are concentric with the plurality of first jack screw holes 84. The first jack screw holes 84 are circumferentially spaced apart from each other about the engine center axis A. The first 84 and second 86 jack screw holes are circumferentially offset from the aligned first 70, second 72, and third 74 fastener holes. Each first jack screw hole 84 has a first center axis C1 (FIG. 5). The second jack screw holes 86 are circumferentially spaced apart from each other about the engine center axis A. Each second jack screw hole 86 has a second center axis C2 (FIGS. 5 and 6). Each first jack screw hole 84 is axially aligned with one second jack screw hole 86 such that the first C1 and second C2 center axes are concentric as shown in FIG. 5.

In one example, each first jack screw hole 84 has a first diameter D1 and each second jack screw hole 86 has a second diameter D2 that is greater than the first diameter D1 (FIG. 5). The first 84 and second 86 jack screw holes are threaded holes. A first jack screw 88 threadably engages the first jack screw hole 84 and passes through a respective second jack screw hole 86 that is concentric with the first jack screw hole 84 to remove the first flange 64 from the second flange 66 (FIG. 5). A distal end 90 of the first jack screw 88 reacts against the third flange 68 as the first jack screw 88 is screwed into the first jack screw hole 84 such that the first flange 64 can be axially pulled away from the second flange 66.

Once the first flange 64 has been removed, a second jack screw 92 threadably engages the second jack screw hole 86 to remove the second flange 66 from the third flange 68 (FIG. 6). A distal end 94 of the second jack screw 92 reacts against the third flange 68 as the second jack screw 92 is screwed into the second jack screw hole 86 such that the second flange 66 can be axially pulled away from the third flange 68.

The first jack screw 88 has a first diameter S1 (FIG. 5) and the second jack screw 92 has a second diameter S2 (FIG. 6). In one example, the second jack screw 92 has a larger diameter S2 than the diameter S1 of the first jack screw 88. This allows the smaller first jack screw 88 to pass through the larger diameter D2 of the second jack screw hole 86 unimpeded such that the distal end 90 of the first jack screw 88 can react against the third flange 68 without engaging the threads of the second jack screw hole 86. Optionally, the reverse configuration could also be used where the first jack screw holes have a larger diameter than the second jack screw holes, which would also require the first jack screw to have a larger diameter than the second jack screw. In this configuration, a distal end of the larger first jack screw would react against a surface area that surrounds the smaller diameter second jack screw hole in the second flange.

A method of disassembling the flange assemblies 60, 62 includes the following steps described below. As discussed above, the flange assemblies 60, 62 include at least two flanges, and in the example shown include at least the first flange 64, the second flange 66, and the third flange 68 that are assembled together with the plurality of fasteners 76. The first flange 64 has the first jack screw holes 84 and the second flange 66 has the second jack screw holes 86 that are concentric with the first jack screw holes 84. In the example shown, there are six first 84 and second 86 concentric jack screw holes (FIG. 3); however, it should be understood that there could be fewer or additional holes as needed. To disassemble the flange assemblies 60, 62, the fasteners 76 are removed. In the example shown, there are eight fasteners 76; however, there could be fewer or additional fasteners 76 as needed.

Once the fasteners are removed, the first jack screws 88 are inserted into the first jack screw holes 84 to remove the first flange 64 from the second 66 and third 68 flanges. Once the first flange 64 has been removed, the second, larger jack screws 92 are inserted into the second jack screw holes 86 to remove the second flange 66 from the third flange 68. Each first jack screw 88 hole has a smaller diameter S1 than the diameter S2 of the second jack screw 92 such that as the first jack screw 88 is threaded into the first jack screw hole 84, the distal end 90 of the first jack screw 88 passes through the second jack screw hole 86 to react against the third flange 68 to remove the first flange 64 from the second flange 66 as the first jack screws 88 are threaded through the first jack screw holes 84. The first jack screw hole 84 has a first screw diameter D1 that threadably matches the diameter S1 of the first jack screw 88. The second jack screw 92 has a second screw diameter S2 that threadably matches the diameter D2 of the second jack screw hole 86. The second diameter D2 is greater than the first diameter D1 such that as the second jack screw 92 is threaded into the second jack screw hole 86, the distal end 94 of the second jack screw 92 reacts against the third flange 68 to remove the second flange 66 from the third flange 68 as the second jack screws 92 are threaded through the second jack screw holes 86.

In one example, there may be a concern that when the first flange 64 is removed, the second flange 66, which is tightly fit to the first flange 64, may also come off with the first flange 64. In order to address this potential issue, in one alternate embodiment one or more of the fasteners 76*a* are located in the cut-out 80 along the outer peripheral edge 82 of the first flange 64 such that these fasteners 76*a* do not pass through the first flange 64 and are only used to connect the second flange 66 to the third flange 68. In this example configuration, all fasteners that extend through all three flanges 64, 66, 68 are first removed. This leaves one or more of the fasteners 76*a* to positively retain the second flange 66 to the third flange 68 as the first flange 64 is removed from the flange assembly 60, 62.

Once the main set of fasteners 76 are removed, the first jack screws 88 are then inserted into the first jack screw holes 84 and are rotated to pull the first flange 64 away from the second flange 66 as described above. The positive retention of the one or more fasteners 76*a* connecting only the second flange 66 to the third flange 68 ensures that the first flange 64 is removed without simultaneously removing the second flange 66 from the third flange 68. Then, subsequent to removing the first flange 64 from the second flange 66, the one or more fasteners 76*a* are removed from the second 66 and third 68 flanges. Then the second jack screws 92 are inserted into the second jack screw holes 86 to remove the second flange 66 from the third flange 68.

The subject invention ensures a simple and effective method of flange disassembly that can be packaged and utilized on and within a set of flanges with limited space for disassembly features. The subject invention concentrically locates two sets of jack screw holes within axially adjacent flanges, which minimizes real estate consumed within each flange by disassembly features, e.g. jack screw holes. The concentrically located jack screw holes allow a first jack screw of a small diameter to pass through a larger diameter jack screw hole in a second flange located between a first flange with a threaded hole for the first jack screw and a retaining housing flange. Once the first flange has been removed using the smaller jack screws, the second flange can be removed from the retaining housing using larger diameter jack screws that are threaded into the larger sized jack screw holes in the second flange. Thus, the subject invention effectively stacks disassembly features on top of each other to allow for additional space within and through the flanges for other critical design features.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A gas turbine engine component comprising:

a first flange with a plurality of first jack screw holes;

a second flange attached to the first flange and including a plurality of second jack screw holes that are concentric with the plurality of first jack screw holes, and wherein the second jack screw holes have a different size than the first jack screw holes;

a first jack screw configured to threadably engage one first jack screw hole; and a second jack screw configured to threadably engage one second jack screw hole.

2. The gas turbine engine component according to claim 1, wherein each first jack screw hole has a first diameter and each second jack screw hole has a second diameter that is different than the first diameter.

3. The gas turbine engine component according to claim 2, wherein the first jack screw is configured to engage one first jack screw hole and pass through a respective second jack screw hole that is concentric with the one first jack screw hole to remove the first flange from the second flange.

4. The gas turbine engine component according to claim 1, wherein the first flange includes a plurality of first fastener holes and the second flange includes a plurality of second fastener holes that are concentric with the plurality of first fastener holes, and including a plurality of fasteners that are received within the first and second fastener holes to attach the first and second flanges to a third flange.

5. The gas turbine engine component according to claim 4, wherein the first and second jack screw holes are circumferentially offset from the first and second fastener holes.

6. The gas turbine engine component according to claim 1, wherein the first and second flanges extend around an engine center axis, and wherein the first and second flanges are directly axially adjacent to each other in a direction along the engine center axis.

7. The gas turbine engine component according to claim 6, wherein the first jack screw holes are circumferentially spaced apart from each other about the engine center axis and wherein each first jack screw hole has a first center axis, and wherein the second jack screw holes are circumferentially spaced apart from each other about the engine center axis and wherein each second jack screw hole has a second center axis, and wherein each first jack screw hole is axially aligned with one second jack screw hole such that the first and second center axes are concentric.

8. A gas turbine engine component comprising:

a first flange with a plurality of first jack screw holes;

a second flange attached to the first flange and including a plurality of second jack screw holes that are concentric with the plurality of first jack screw holes, and wherein each first jack screw hole has a first diameter and each second jack screw hole has a second diameter that is different than the first diameter;

a first jack screw configured to engage one first jack screw hole and pass through a respective second jack screw hole that is concentric with the one first jack screw hole to remove the first flange from the second flange; and a second jack screw configured to engage one second jack screw hole to remove the second flange from a third flange.

9. The gas turbine engine component according to claim 8, wherein the second diameter is greater than the first diameter, and wherein the second jack screw has a larger diameter than the first jack screw.

10. A gas turbine engine component comprising:

a first flange with a plurality of first jack screw holes and a plurality of first fastener holes; and a second flange attached to the first flange and including a plurality of second jack screw holes that are concentric with the plurality of first jack screw holes, and wherein the second flange includes a plurality of second fastener holes that are concentric with the plurality of first fastener holes; and a plurality of fasteners that are received within the first and second fastener holes to attach the first and second flanges to a third flange, and wherein the first flange includes at least one cut-out along an outer peripheral edge of the first flange such that at least one fastener of the plurality of fasteners does not pass through the first flange and is only used to connect the second flange to the third flange.

11. A gas turbine engine component comprising:

a first flange with a plurality of first jack screw holes; and a second flange attached to the first flange and including a plurality of second jack screw holes that are concentric with the plurality of first jack screw holes, and wherein the first flange comprises an intershaft seal support flange and the second flange comprises a centering spring flange, and wherein the intershaft seal support flange and the centering spring flange are attached to a bearing support flange with a plurality of fasteners.

12. A gas turbine engine comprising:

a compressor section;

a combustor section downstream of the compressor section;

a turbine section downstream of the combustor section, wherein the compressor and turbine sections include components that rotate about an engine center axis; and wherein at least one of the compressor, combustor, and turbine sections include a first flange with a plurality of first jack screw holes, a first jack screw configured to engage one first jack screw hole, a second flange attached to the first flange with a plurality of fasteners and including a plurality of second jack screw holes that are concentric with the plurality of first jack screw holes and wherein the second jack screw holes have a different size than the first jack screw holes, a second jack screw configured to engage one second jack screw hole, and a third flange that is attached to the first and second flanges with the plurality of fasteners.

13. The gas turbine engine according to claim 12, wherein each first jack screw hole has a first diameter and each second jack screw hole has a second diameter that is greater than the first diameter, and wherein the first jackscrew is configured to engage one first jack screw hole and pass through a respective second jack screw hole that is concentric with the one first jack screw hole to remove the first flange from the second flange subsequent to the plurality of fasteners being removed, and wherein the second jack screw is configured to engage one second jack screw hole to remove the second flange from the third flange.

14. The gas turbine engine according to claim 13, wherein the first and second jack screw holes are threaded, and wherein the second jack screw has a larger diameter than the first jack screw.

15. The gas turbine engine according to claim 13, wherein the first jack screw holes are circumferentially spaced apart from each other about the engine center axis and wherein each first jack screw hole has a first center axis, and wherein the second jack screw holes are circumferentially spaced apart from each other about the engine center axis and wherein each second jack screw hole has a second center axis, and wherein each first jack screw hole is axially aligned with one second jack screw hole such that the first and second center axes are concentric.

16. A method comprising:

providing at least a first flange, a second flange, and a third flange that are assembled together with a plurality of fasteners;

providing the first flange with a plurality of first jack screw holes and the second flange with a plurality of second jack screw holes that are concentric with the plurality of first jack screw holes;

inserting a first jack screw into the first jack screw hole to remove the first flange from the second and third flanges subsequent to removing the plurality of fasteners; and inserting a second jack screw into the second jack screw hole to remove the second flange from the third flange subsequent to removing the first flange.

17. The method according to claim 16, wherein each first jack screw hole has a first diameter and each second jack screw hole has a second diameter that is greater than the first diameter such that as the first jack screw is threaded into the first jack screw hole, a distal end of the first jack screw passes through the second jack screw hole to react against the third flange to remove the first flange from the second flange.

18. The method according to claim 17, wherein the first jack screw has a first screw diameter and the second jack screw has a second screw diameter that is greater than the first screw diameter such that as the second jack screw is threaded into the second jack screw hole, a distal end of the second jack screw reacts against the third flange to remove the second flange from the third flange.

19. The method according to claim 18, wherein the first and second jack screw holes are circumferentially offset from fastener holes that receive the plurality of fasteners, and including forming at least one cut-out along an outer peripheral edge of the first flange such that at least one fastener of the plurality of fasteners does not pass through the first flange and is only used to connect the second flange to the third flange, removing all fasteners from the plurality of fasteners except for the at least one fastener that connects the second flange to the first flange, and subsequently inserting the first jack screw into the first jack screw hole to remove the first flange from the second flange while the at least one fastener fixes the second flange to the third flange.

20. The method according to claim 19, including subsequent to removing the first flange from the second flange, removing the at least one fastener from the second and third flanges, and inserting the second jack screw into the second jack screw hole to remove the second flange from the third flange.

* * * * *